US007065930B2

(12) United States Patent
Schulze

(10) Patent No.: US 7,065,930 B2
(45) Date of Patent: Jun. 27, 2006

(54) WELDMENT PLATE SPACER SUPPORT

(76) Inventor: Todd M. Schulze, 182 New Path Rd., Dunn, NC (US) 28334

( * ) Notice: Subject to any disclaimer, the term of this patent is extended or adjusted under 35 U.S.C. 154(b) by 0 days.

(21) Appl. No.: 10/964,143

(22) Filed: Oct. 13, 2004

(65) Prior Publication Data

US 2005/0082460 A1 Apr. 21, 2005

Related U.S. Application Data

(60) Division of application No. 10/272,698, filed on Oct. 16, 2002, now Pat. No. 6,820,390, which is a continuation-in-part of application No. 09/777,400, filed on Feb. 6, 2001, now Pat. No. 6,823,635.

(51) Int. Cl.
*E04C 3/16* (2006.01)

(52) U.S. Cl. ..... 52/365; 52/677; 52/676; 52/372; 52/514

(58) Field of Classification Search ..... 52/365, 52/677, 676, 372, 541, 678, 718.04, 742.1, 52/126.4, 524, 326, 335, 340, 414, 443, 704
See application file for complete search history.

(56) References Cited

U.S. PATENT DOCUMENTS

| | | | | |
|---|---|---|---|---|
| 488,349 | A | | 12/1892 | Bradley |
| 1,578,947 | A | | 10/1926 | Alber |
| 1,596,039 | A | | 10/1926 | Whittaker |
| 1,769,498 | A | | 10/1930 | Downing |
| 2,319,526 | A | | 10/1943 | Wearn |
| 3,333,380 | A | | 8/1967 | Wolf |
| 3,572,001 | A | | 3/1971 | Munchinsky |
| 3,878,659 | A | | 4/1975 | Pfeifer |
| 4,229,920 | A | | 10/1980 | Lount |
| 4,234,156 | A | | 11/1980 | Wepf |
| 4,571,912 | A | * | 2/1986 | Fricker ..... 52/710 |
| 4,823,527 | A | | 4/1989 | Harbeke |
| 4,936,540 | A | | 6/1990 | Boeshart |
| 5,107,648 | A | | 4/1992 | Roby |
| 5,509,636 | A | | 4/1996 | Cotugno |
| 5,582,388 | A | | 12/1996 | Baxter |
| 5,638,652 | A | | 6/1997 | Shinoda et al. |
| 5,653,082 | A | | 8/1997 | Shinoda et al. |
| 5,743,062 | A | * | 4/1998 | Fricker ..... 52/704 |
| 5,857,296 | A | | 1/1999 | Niday et al. |
| 5,941,045 | A | | 8/1999 | Plehanoff et al. |
| 6,067,757 | A | | 5/2000 | Olson et al. |

* cited by examiner

*Primary Examiner*—Daniel P. Stodola
*Assistant Examiner*—Nahid Amiri
(74) *Attorney, Agent, or Firm*—Dennis G. LaPointe

(57) ABSTRACT

A spacer support having a body portion, a surface engaging portion and a securement to attach the body portion to a weldment plate in tilt-up construction is disclosed. In a first embodiment, the securement includes a resilient clip that can snap onto a Nelson stud. One or more shelves on the support spacer prevent longitudinal movement of the Nelson stud. The length of the spacer support may be adjusted manually by cutting the body to length or by rotating one threaded member relative to a second to accommodate different thicknesses of walls. The spacer support is preferably plastic but may be metal. In another embodiment, a clamp secures an elongate body portion to a weldment plate projection.

7 Claims, 9 Drawing Sheets

WELDMENT PLATE SPACER SUPPORT

RELATED APPLICATIONS

This application is a divisional of U.S. patent application Ser. No. 10/272,698 filed Oct. 16, 2002, now U.S. Pat. No. 6,820,390 issued Nov. 23, 2004, which is a continuation-in-part of U.S. patent application Ser. No. 09/777,400 filed Feb. 6, 2001, now U.S. Pat. No. 6,823,635, issued Nov. 30, 2004.

The present invention relates to the manufacture of concrete walls used in tilt-up construction. More particularly, the present invention is directed to a spacer support that holds a weldment plate in proper position until the wet concrete sets up.

In commercial construction, as well as in residential construction where wood is at a premium, builders are increasingly using tilt-up construction, that is, they are pouring concrete walls in forms as they lay on the ground, floor or other surface, and then tilting them up into the desired position after the concrete has cured. One of the features such construction affords is the placement of a weldment plate on one surface of the wall so that structural support beams, and the like, may be welded/secured between adjacent walls. In current practice, the concrete wall is poured and then the weldment plate is "floated" on the top of the wet cement. Since these steel plates are denser than the wet concrete, they tend to sink below the surface. Accordingly, it sometimes becomes necessary to allow the concrete to take a partial set and then attempt to push the weldment plate into the desired position. Neither of these current practices provides effective quality control and the results often are not those desired.

The device of the present invention comprises a spacer support that engages the support surface on which the concrete wall is poured and a weldment plate holding it in the desired position relative to that surface during the curing of the concrete. The spacer support comprises an elongate body portion having a length substantially equal to the thickness of the concrete wall minus a dimension of the weldment extending in the direction of the thickness of the concrete wall; a surface engaging portion for contacting the surface on which the concrete wall is poured and supporting the weldment in a position appropriately spaced from that surface; means for attaching said body portion to the weldment, wherein the weldment will be maintained in a desired position as wet concrete is poured and sets up.

Weldment plates take different forms: some are simply rectangular metal plates with two smooth surfaces. Other weldment plates are equipped with protrusions on one surface that improve the adhesion of the plate to the wall enabling greater weight to be suspended therefrom. These protrusions typically take the form of a plurality of Nelson studs welded to the surface of the plate that is to be embedded in the concrete. These studs can have shaft diameters of ¼", ⅜", ½", ⅝" with head diameters graduated by ¼" increments between ½" and 1¼". For weldment plates that have no protrusions, the support spacer will have additional length (as compared to those engaging the heads of Nelson studs) and be equipped with a flat head that can be adhered to the nether surface of the weldment plate by an adhesive such as LIQUID NAILS (a registered trademark of Macco). The spacer supports will be used on each weldment plate positioned to provide balance in the wet concrete. The embodiment of support spacer engaging the Nelson stud will have a plurality (three shown) of fingers that grip the head of the stud, the fingers having portions that snap beneath the head and retain the spacer support in position while the concrete sets up. This configuration will be made in a plurality of sizes to accommodate the various sizes of Nelson stud heads.

In another embodiment, the shaft of the Nelson Stud is attached to the spacer support by a resilient clip. One or more shelves on the spacer support engage the head of the Nelson stud to prevent the stud from sinking into the cement. The shelf can be continuous across the spacer support below the head of the Nelson stud.

To accommodate different sized heads using identical spacer supports, a flat walled doughnut shaped spacer having an interior circumference matching that of the outer diameter of the head of the Nelson stud and an exterior circumference matching that of the interior circumference of spacer support in the area supporting the Nelson stud is employed. The spacer support is preferably made of a material selected from the group consisting of plastic, metal, and powdered metal. The end contacting the support is preferably pointed to minimize the surface treatment needed for the wall and, typically, the wall may simply be painted, papered or given any other conventional treatment, without the tips of the spacer/supports affecting the treatment. The length of the body portion of the spacer support may be adjusted in either of two ways: the surface may be scored at any of a plurality of conventional lengths, and the spacer support cut to the length appropriate for the wall thickness with which it is used; the spacer support includes two parts that may be adjusted relative to each other to achieve the desired length. Preferably, these pieces are threadingly engaged and the length can be readily adjusted by rotating one of the pieces relative to the other. This feature may be added to either the flat-head or fingered configurations.

Various other features, advantages and characteristics of the present invention will become apparent to one of ordinary skill in the art after a reading of the following specification.

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
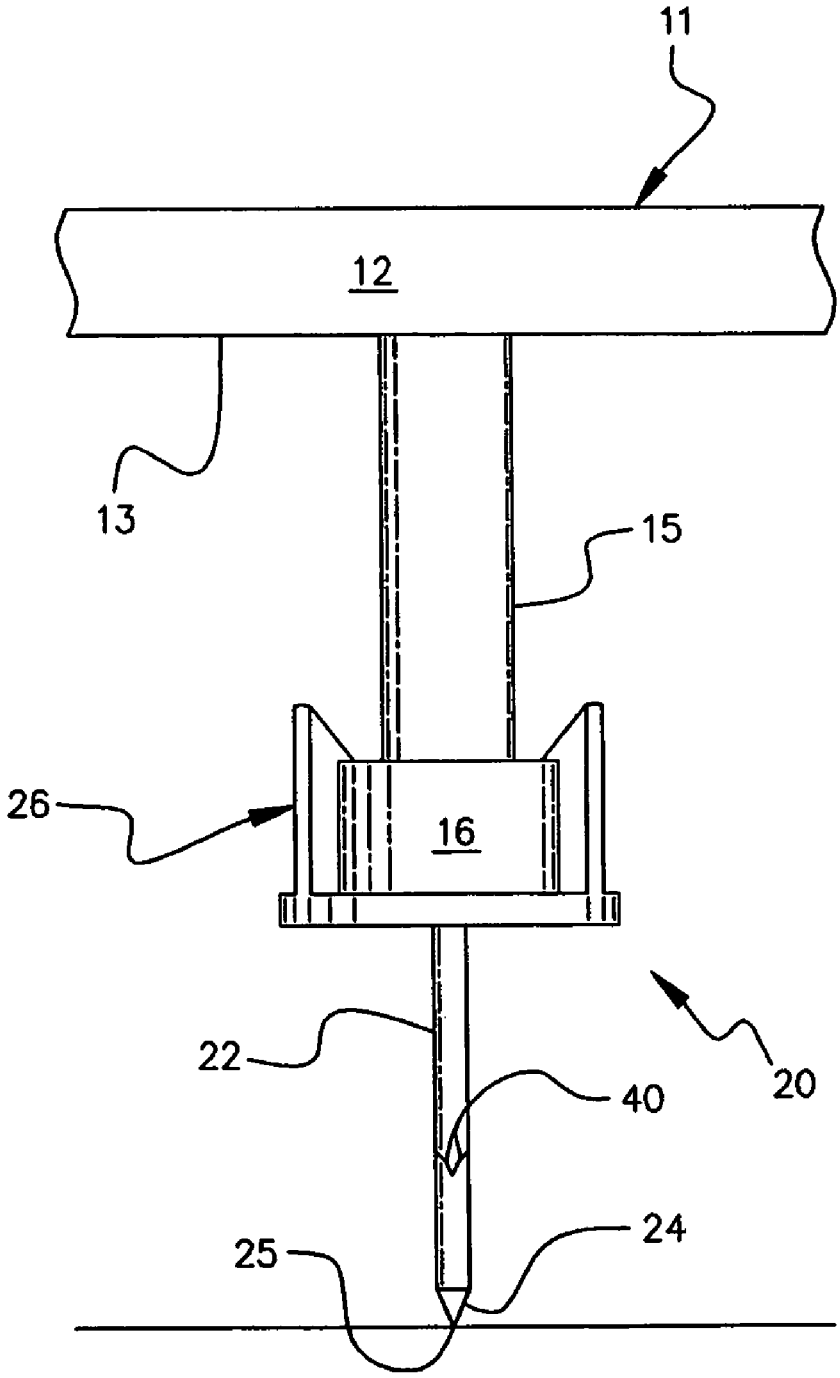
FIG. 1 is a side view of a first embodiment of the weldment spacer support of the present invention shown assembled on a Nelson stud.
Figure 2A:
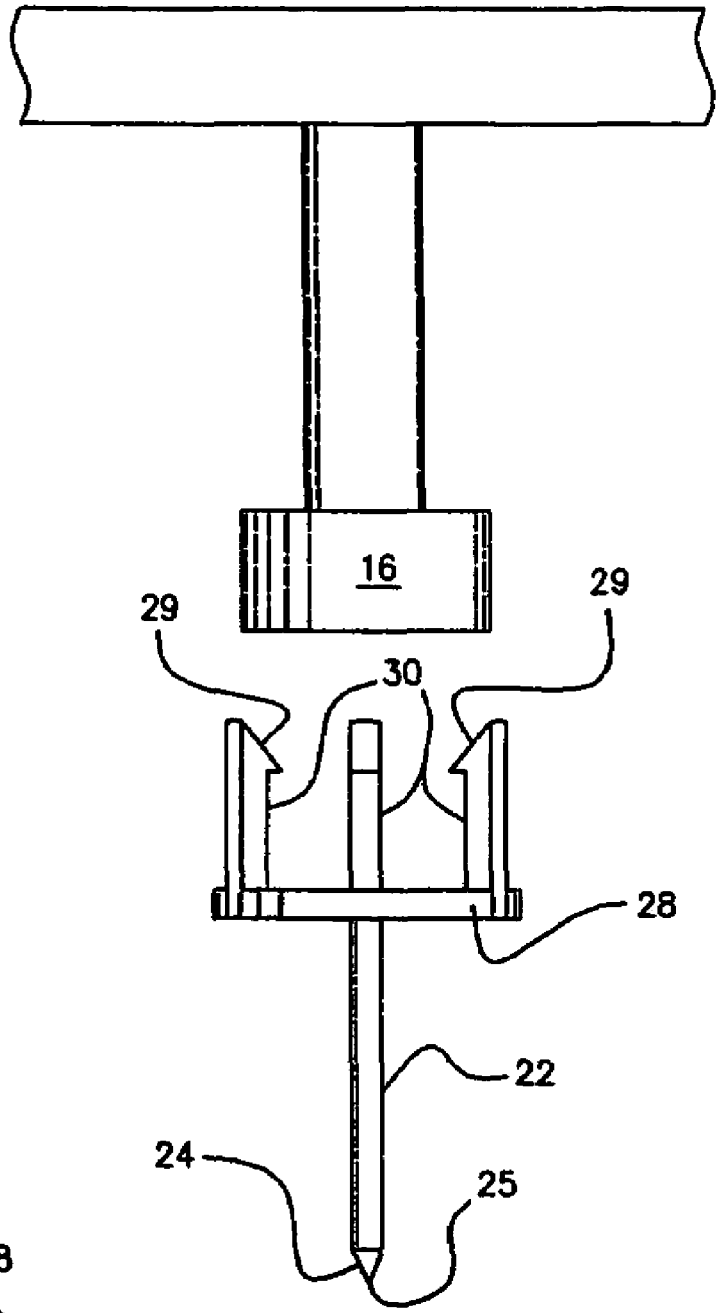
FIG. 2A is an exploded side view of the spacer support shown in FIG. 1.
Figure 2B:
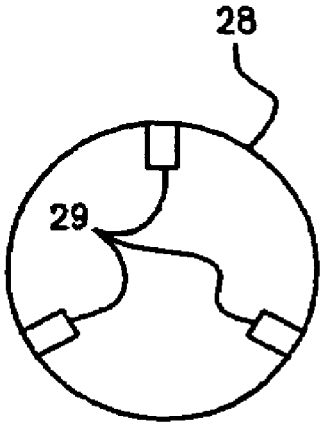
FIG. 2B is a top view of the first embodiment.
Figure 3:
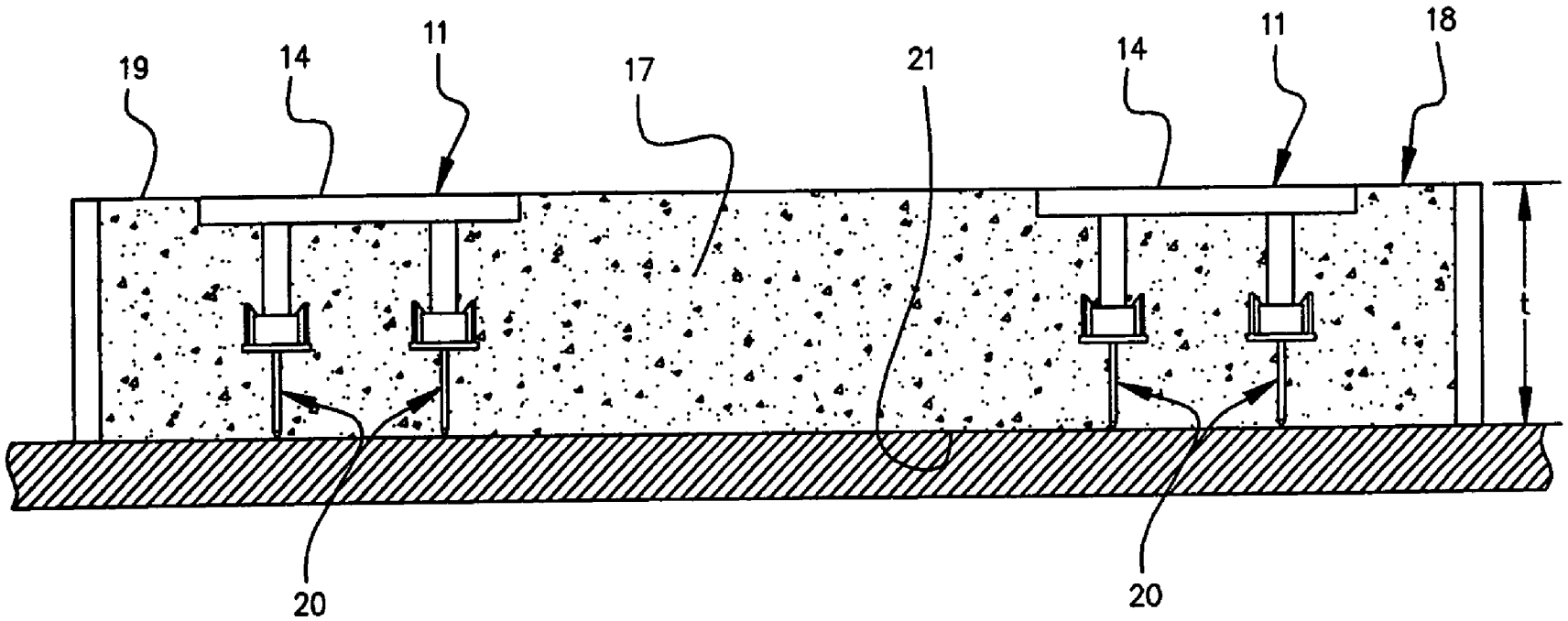
FIG. 3 is a schematic view showing the spacer supports used to suspend a pair of weldment plates on a tilt-up wall.

A first embodiment of the weldment plate spacer support is shown in FIGS. 1–3 generally at 20. Weldment spacer support comprises an elongated body portion 22, a surface engaging portion 24, and means 26 for attaching the spacer support to weldment plate 11. In this embodiment, weldment plate 11 includes projections 15 which may take the form of Nelson studs welded to the surface 13 of weldment plate 11 to be embedded in the concrete 17 (FIG. 3). Body portion 22 is of a length substantially equal to the thickness t of the concrete wall 18 minus a dimension of the weldment plate 11 extending in a direction of the thickness of the concrete wall 18. In this case, the dimension of the weldment plate extending in the direction of the thickness of wall 18 includes the thickness of plate 12 as well as the length of Nelson stud 15. Nelson studs come in a plurality of sizes and lengths. Common diameters include ¼", ⅜", ½", ⅝" with head diameters of ½", ¾", 1" and 1¼" respectively. The heads 16 also vary in depth having lengths of 0.187 inch, 0.281 inch, 0.312 inch, and 0.312 inch, respectively, for the diameters listed here. The length of body portion 22 will be designed to position the weldment plate 12 where desired, typically with upper surface 14 flush with the surface 19 of wall 18.

Surface engaging portion 24 preferably comes to a point 25 so as to minimize the amount of weldment spacer support that protrudes on surface 21. Accordingly, minimal accommodation will be necessary to treat the points 25 on wall 18. In fact, it is anticipated that the painting, papering or other treatment provided wall surface 21 will adequately cover the points 25. It is preferred that the length of body portion 22 will be adjustable. One such means can be the cutting of body portion 22 to the desired length to place weldment plate 12 flush with the designed wall surface 19 once concrete 17 is poured. To facilitate this cutting (or breaking), body 22 may be provided with scoring lines 40 at one or more conventional wall thicknesses/stud lengths so the point 25 may be maintained.

The material from which weldment plate spacer support is made is selected from the group consisting of plastic, metal, and powdered metal. It is envisioned that a durable, tough plastic material such as nylon or polypropylene, possibly with glass or carbon fiber reinforcement will be suitable for this application and provide the most cost effective means of solving this problem. It is, however, possible that for certain applications, the strength requirements will dictate that the weldment plate spacer support 20 be manufactured from metal including but not limited to powdered metal. The spacer support 20 of the present invention could be cast or machined from aluminum, from example.

Figure 4:
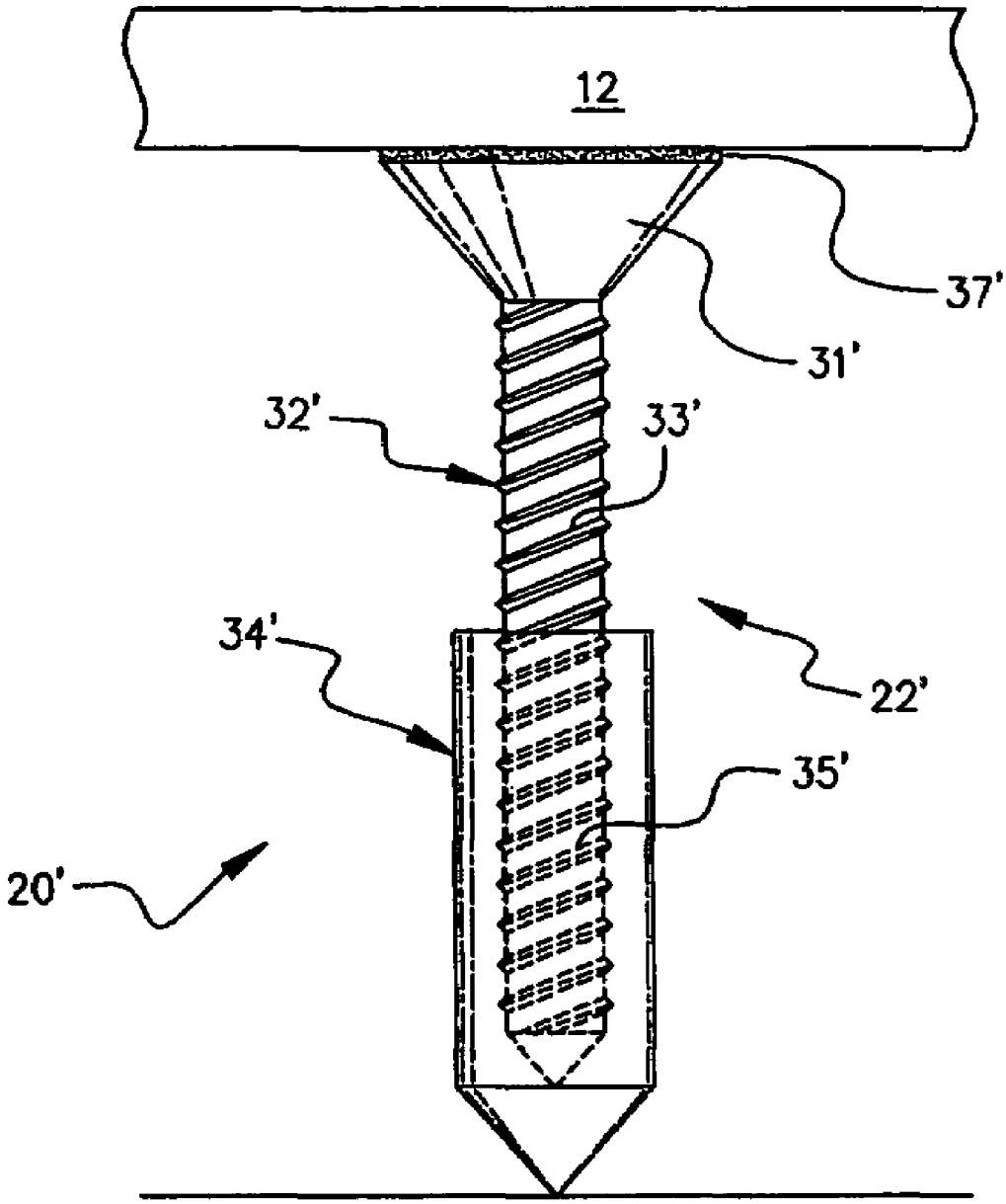
FIG. 4 is a second embodiment of the weldment spacer support of the present invention for use with a weldment plate.

Means 26 for attaching body portion 22 to weldment plate 11 comprises a plurality of fingers 30 (shown exemplarily as three in number) with portions 29 that snap in behind stud heads 16. As seen in FIGS. 2A and 2B, fingers 30 are equally spaced about the periphery of head securement 28. However, it is envisioned that as few as one that substantially engulfs stud head 16 and as many as six or more fingers could be utilized to effect attachment to head 16. If only one or two fingers 30 were utilized, they would have an extended peripheral span to stabilize their hold on head 16. It is preferred for stability reasons, that there be three or more fingers 30. The depth of head securement 28 will be sized to accommodate the length of stud head 16 and the diameter will similarly be properly sized to receive the particular diameter of stud head 16. A second embodiment of weldment plate spacer support is shown in FIG. 4 generally at 20'. In this embodiment, body portion 22' is formed by a first component 32' and a second component 34' that can be longitudinally moved with respect to each other to vary the length, as desired. This variation in length is effected by rotating one of the components 32', 34' with respect to the other. The complementarily engaged threads 33' and 35' will produce the desired variation in length. The head 31' of first component 32' is designed for attachment to a weldment plate 12 that has no projections. An adhesive 37' such as LIQUID NAILS may be used to secure the spacer support 20' to the surface 13 of weldment plate 12. A minimum of three spacer supports 20' dispersed in a triangular pattern is preferred to assure stable placement of the weldment plate 12, although two would be sufficient.

In use (FIG. 3), weldment plate spacer supports 20 are attached to weldment plate 11 as by snapping finger portions 29 over projection heads 16. The length of spacer supports 20 will have been previously adjusted to position the surface 14 at the desired reference plane with respect to upper surface 19 of concrete wall 18. The thusly equipped weldment plate 11 is situated inside concrete forms on surface which may, for example, be a plastic sheeting material, and concrete 17 poured into forms. Weldment plate spacer supports 20 hold plates 11 in the desired position while the concrete 17 sets up. When the concrete 17 has properly set, tilt-up wall 18 can be uprighted and secured in position. The smallness of points 25 will have minimal/no effect on the surface treatment required to finish wall surface 21.

Figure 5:
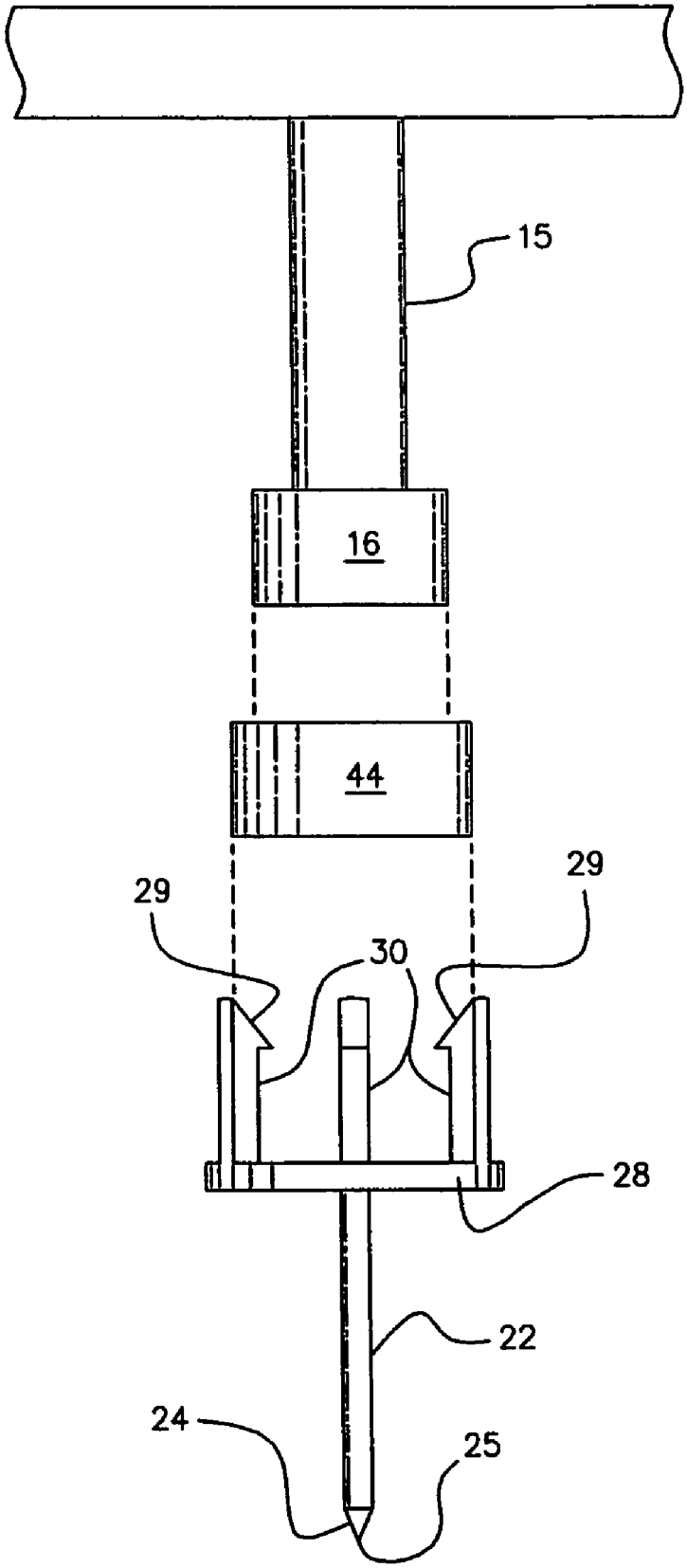
FIG. 5 is a side view, partially in section, showing the use of a flat walled doughnut shaped spacer to accommodate a reduced sized head on a Nelson stud.

In order that a large head securement 28 can be employed with various diameter heads 16 of Nelson studs 15, flat walled doughnut shaped spacers 44 can be placed on the heads to secure a good fit (FIG. 5). The doughnut shaped spacers can be employed using the head securement 28 described above or the shelve and resilient clip securement described below.

Figure 6A:
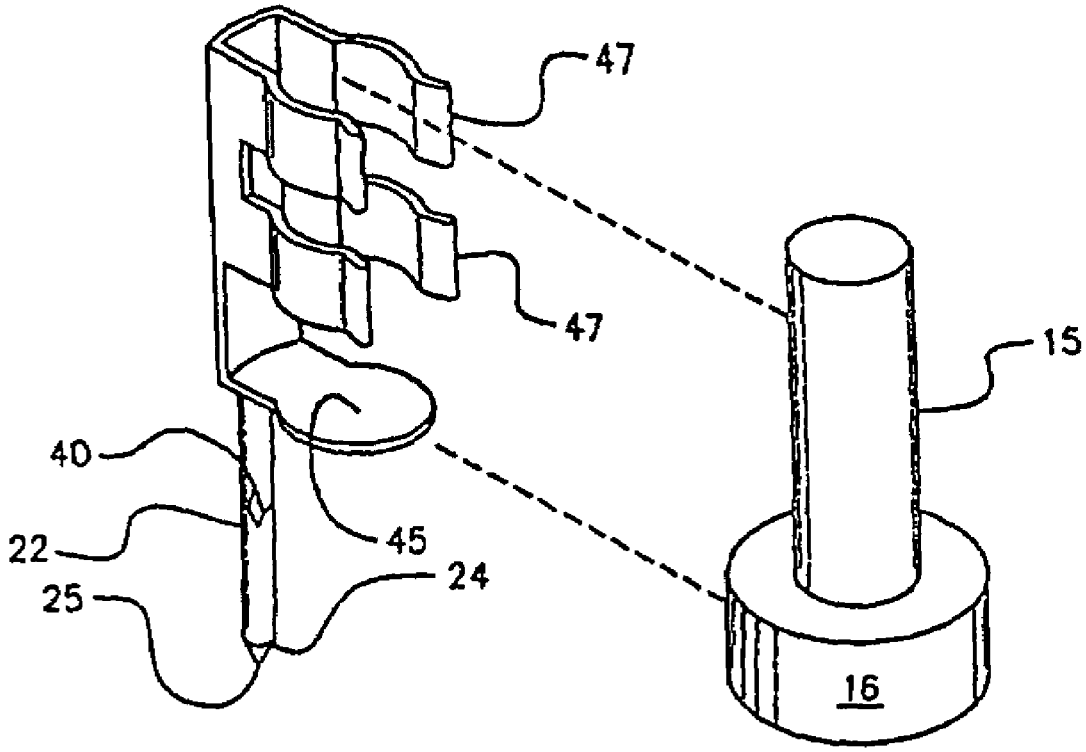
FIG. 6A is a side view showing the use of a shelf to support the head of a Nelson stud.

An alternative embodiment is shown in FIG. 6A, wherein a shelf 45 protrudes from leg 22. Shelf 45 supports head 16 of Nelson stud 15. Nelson stud 15 is held in place on leg 22 by resilient clip 47. Leg 22 has spaced-apart weakened areas 40 (typically every one-fourth inch) so that leg 22 can be broken off for height adjustment. These break-off points 40 can actually be manufactured to any desired incremental dimension, e.g., ⅛ inch, ⅜ inch, etc.

Figure 6B:
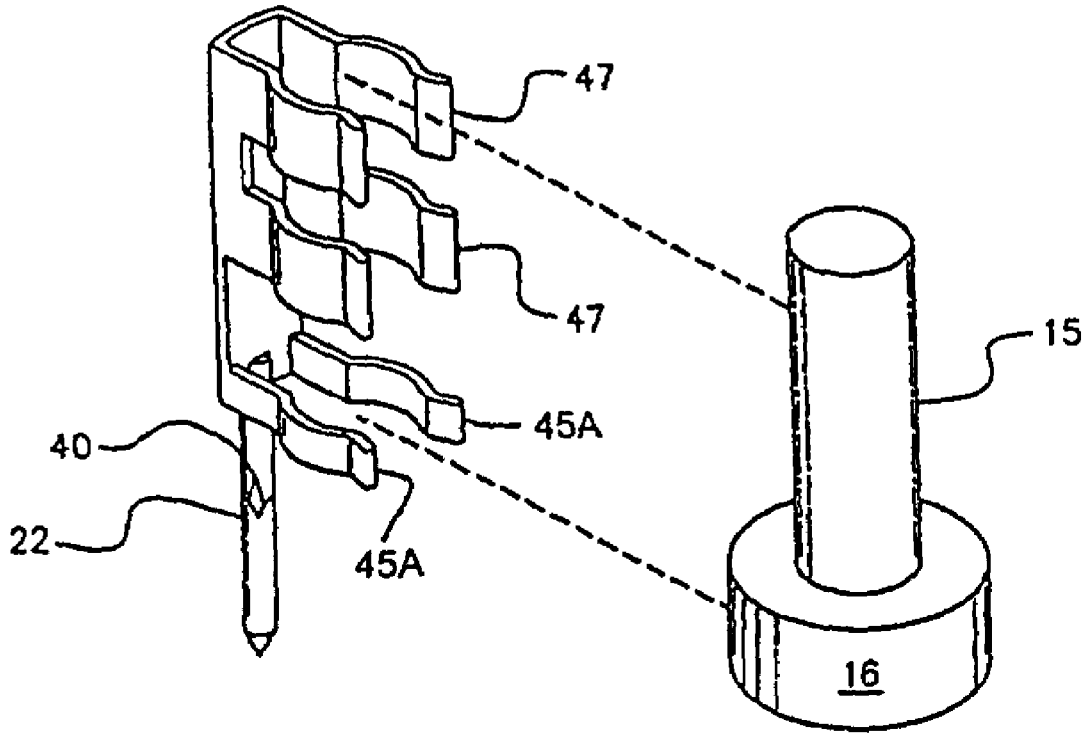
FIG. 6B is a front view showing the use of two shelves to support the head of a Nelson stud.

As is shown in FIG. 6B, two spaced-apart shelves or supports 45A can be employed to support head 16 of Nelson stud 15. The other elements of FIG. 6B are the same as those of FIG. 6A. The shelves 45 are spaced-apart and located below the resilient clip 47 so that the head portion 16 of the Nelson stud or projections 15 can be supported in relation to the elongate body 22 by resting thereon.

Figure 7:
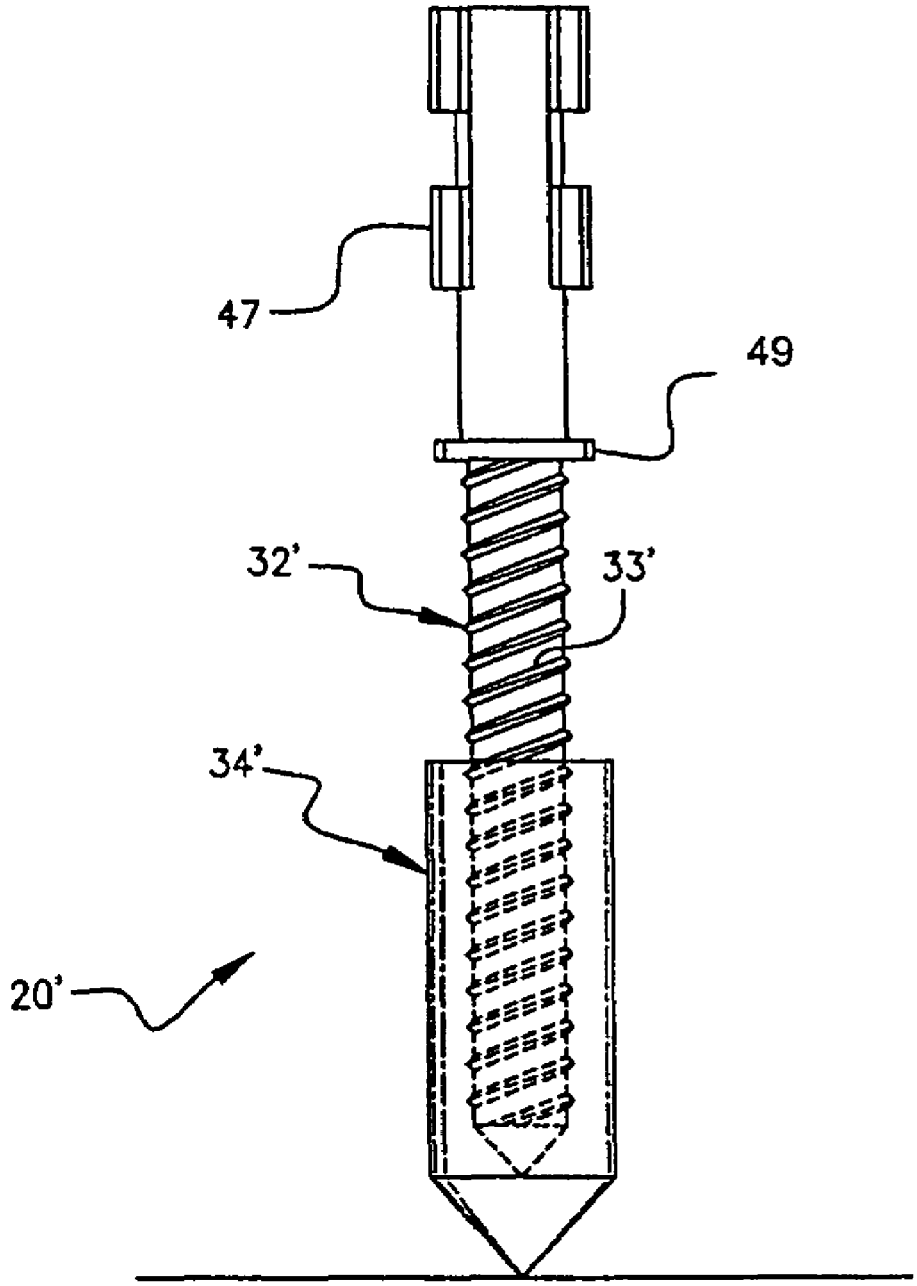
FIG. 7 is a front view of a continuous shelf for the spacer support in combination with a screw type length adjustment mechanism for the spacer support
Figure 8:
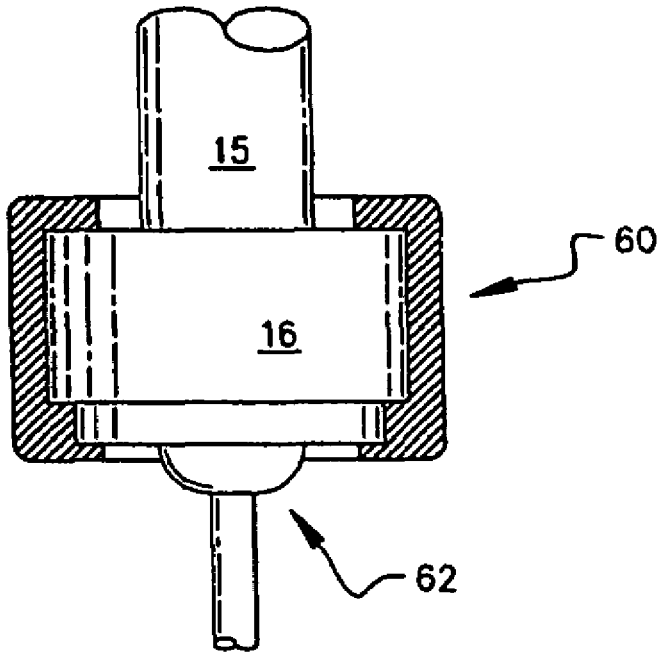
FIG. 8 is a third embodiment of the invention using a clamping ring with a stem portion wherein the clamping ring secures both the upper portion of a stem portion and the Nelson Stud head.

Turning now to FIG. 7, there is shown a continuous shelve 49 in combination with a resilient clip 47 in combination with a spacer support 20'. The operation of spacer support 20' is discussed above in the description of FIG. 4.

FIGS. 8–11 depict another embodiment of the invention. In this embodiment, the elongate body portion 62 is generally T-shaped with a generally circular horizontal upper portion 70 and a stem portion 72 depending therefrom.

Means for joining the elongate body upper portion 70 with the weldment plate projections 16 includes clamping means 60.

Figure 9:
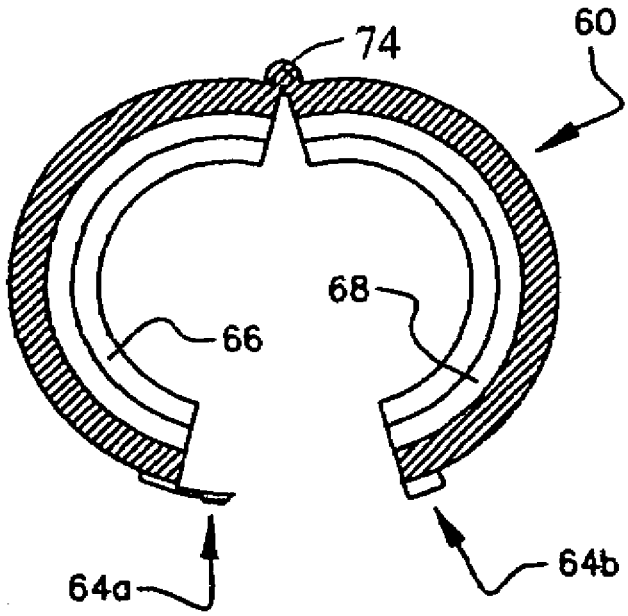
FIG. 9 is a top view of the clamping portion of the embodiment of FIG. 8.
Figure 10:
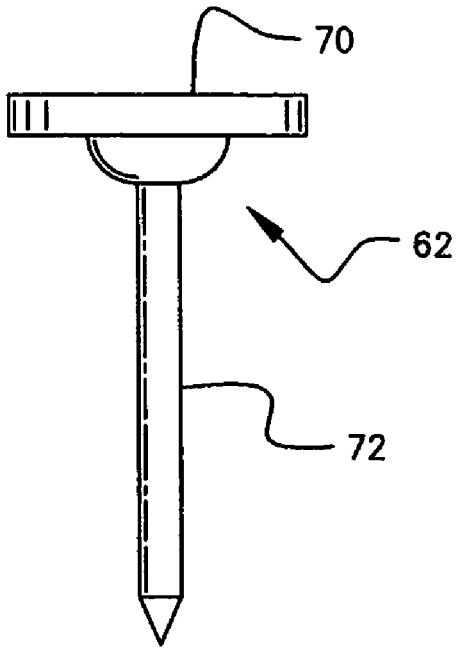
FIG. 10 is a elevation view of the stem or leg portion of the embodiment of FIG. 8.
Figure 11:
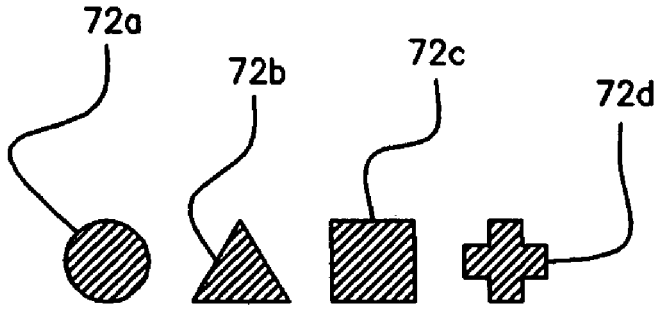
FIG. 11 depicts the various typical cross-sections of the depending stem leg of FIG. 10.

As shown in FIG. 9, two opposite and generally C-shaped portions 68 are joined at corresponding opposite ends with hinge means 74 to selectively open and clamp the C-shaped portions 68. The C-shaped portions 68 further has locking means, shown as 64*a*,64*b* in the drawing, to maintain the C-shaped portions in a clamped position. It is understood that other locking means are contemplated and that shown is simply one typical application. The locking means 64*a*,64*b* may be in the form of interlocking teeth or other forms of gripping structure as depicted at 64*a*. This form of locking means 64*a*,64*b* allows for fine adjustment, making a snug fit for the different manufactures and variance of sizes with weldment plate projections and heads.

The C-shaped portions 68 are sized to secure and clamp together the head portion 16 of the weldment plate projections and the elongate body upper portion 70 with the elongate body upper portion 70 underlying the head portion 16. The stem portion 72 can have adjustable means, including break off segments, similar to the previously described embodiments. The stem portion can also have a number of cross-sectional shapes, including those shown as typical examples, in FIG. 11, where 72*a* is has a round cross-section, 72*b* has a triangular cross-section, 72*c* has a square cross-section and 72*d* has a "plus" or cross cross-section.

As with the other previous embodiments, the material to make this embodiment can be plastic, metal, powdered metal and combinations thereof. The hinge means 74 can be made as a thin section of plastic or be incorporated with stamped metal.

Various changes, alternatives and modifications will become apparent to one of ordinary skill in the art following a reading of the foregoing specification. For example, while the two component adjustable embodiment has been depicted only with the flat head design, it will be understood it can easily be adapted for use with the fingered securement head 28. It is intended that any such changes, alternatives and modifications as fall within the scope of the appended claims be considered part of the present invention.

What is claimed is:

1. A device for clamping to a head portion of a weldment plate projection to support the weldment plate during the formation of a concrete wall said device comprising:

an elongate body portion having a length substantially equal to the thickness of the concrete wall minus a dimension of the weldment plate extending in a direction of the thickness of the concrete wall;

a surface engaging portion for contacting a surface on which the concrete wall is poured and supporting the weldment plate in a position appropriately spaced from that surface;

the elongate body portion being generally T-shaped with a generally circular horizontal upper portion and a stem portion depending therefrom; and clamping means for clamping the elongate body upper portion to the head portion of the weldment plate projection, said clamping means comprising two opposite and generally C-shaped portions, said portions being joined at corresponding opposite ends with hinge means for selectively opening and closing the C-shaped portions, the C-shaped portions further having locking means for maintaining the C-shaped portions in a clamped position.

2. The device according to claim 1, wherein said length of said elongate body portion is adjustable.

3. The device according to claim 2, wherein said length is adjustable by manually removing excess length.

4. The device according to claim 1, wherein said surface engaging portion includes a section which tapers to a point to minimize surface treatment of the concrete wall needed to accommodate said device.

5. The device according to claim 1, wherein a material for said device is selected from a group consisting of plastic, metal, powdered metal and combinations thereof.

6. The device according to claim 1, wherein the projections are Nelson studs welded to the nether side of the plate member.

7. The device according to claim 1, further comprising an inner shelf portion surrounding a lower perimeter of the C-shaped portion, upon which the upper portion of the elongate body portion rests when depending from the clamping means.

* * * * *